United States Patent [19]

Meyers

[11] Patent Number: 4,573,905

[45] Date of Patent: Mar. 4, 1986

[54] BURNER UNIT FOR FIREPLACE SIMULATION

[76] Inventor: Wayne E. Meyers, 401 N. Glen, West Chicago, Ill. 60185

[21] Appl. No.: 670,264

[22] Filed: Nov. 13, 1984

[51] Int. Cl.[4] ..... F23Q 2/32

[52] U.S. Cl. ..... 431/125; 219/344; 126/127

[58] Field of Search ..... 126/127, 135, 24; 431/125, 126, 320, 321, 310, 33, 34; 219/344; 40/428; D23/75, 76, 94, 95, 96, 106, 107

[56] References Cited

U.S. PATENT DOCUMENTS

| | | | |
|---|---|---|---|
| D. 100,459 | 7/1936 | Sulzer | D23/106 |
| 1,677,629 | 7/1928 | Gross | 219/344 |
| 1,708,237 | 4/1929 | Pioch | 219/344 |
| 1,719,266 | 7/1929 | Hersh | 219/344 |
| 1,867,740 | 7/1932 | Guy | 126/121 |
| 2,875,747 | 3/1959 | Fish | 126/127 |
| 2,907,316 | 10/1959 | Windost | 126/24 |
| 3,742,189 | 6/1973 | Conroy et al. | 219/344 |
| 3,817,686 | 6/1974 | Quittner | 431/125 |
| 3,890,085 | 6/1975 | Andeweg | 431/125 |
| 4,076,490 | 2/1978 | Hilker | 431/125 |
| 4,126,408 | 11/1978 | Cox | 431/320 |
| 4,272,908 | 6/1981 | Bassetti et al. | 40/428 |
| 4,306,537 | 12/1981 | Mitchell | 431/125 |

FOREIGN PATENT DOCUMENTS

| | | | |
|---|---|---|---|
| 0096111 | 11/1982 | European Pat. Off. | 431/125 |
| 1457538 | 12/1976 | United Kingdom | 431/125 |

*Primary Examiner*—Samuel Scott
*Assistant Examiner*—Helen A. Odar
*Attorney, Agent, or Firm*—John L. Schmitt

[57] ABSTRACT

A burner unit particularly adapted for use in a non-vented dwelling space as a fireplace substitute includes a fuel cell carried on a grate which in turn is connected by support frames to a base plate. The fuel cell has a slidable lid to provide access to a fuel canister holding container portion of the fuel cell. The base plate has a glass covered cutout to allow upward illumination from a light fixture connecting with the unit below the base plate. The burner unit may be installed in an enclosure which in turn may be freestanding, placed in a wall opening or in a furniture piece. To use the unit, fuel in the canisters is ignited to burn with a slight flame and produce heat and toxic-free products of combustion. The light fixture is energized to illuminate rock pieces on the glass and simulate glowing embers under the grate. With artificial log pieces positioned on the grate and fuel cell, the unit provides sensorial effects similar to those of a wood burning fireplace for enjoyment by those in the dwelling space.

7 Claims, 9 Drawing Figures

BURNER UNIT FOR FIREPLACE SIMULATION

BACKGROUND OF THE INVENTION

1. Field of the Invention

This invention relates to burner units to simulate burning in a traditional fireplace and more particularly to units which may be operated in a non-vented dwelling space.

2. Prior Art

Since at least colonial times the fireplace has been a source of heat during cold weather and for cooking. Typically, wood or coal is burned with the products of combustion vented outside by a chimney.

The Franklin stove, invented by Benjamin Franklin in the late 1700's, provided a vastly improved heat source because a greater percentage of the generated heat transferred to the space in which the stove was located while a lesser percentage vented to the outside.

While in most modern dwellings the fireplace is no longer the primary source of heat, an open flame in a living space remains a pleasurable experience for its aesthetic and physiological effects. As such, a number of substitute structures have been suggested to improve heat transfer and eliminate the need for the traditional masonry chimney. U.S. Pat. Nos. 1,867,740, 3,636,307 and 3,742,189 set forth electrical energized heating units with open burning simulation created by a flow of air and light directed through defusing materials.

A structure which provides improved heat transfer is set forth in U.S. Pat. No. 2,134,935 where self-contained ducting is used to transfer heat to room air circulating in the ducting. In U.S. Pat. No. 3,533,394 the products of combustion from a gas log in a fire box are discharged externally by an exhaust fan. This fan also circulates room air in duct work about the fire box. U.S. Pat. No. 3,654,913 discloses a gas fueled fireplace with artificial logs. Heat is generated in a sealed chamber having an inlet and outlet connected to the outside while room air is circulated about the sealed chamber.

In addition to wood, coal, natural gas and electricity as heat sources, other hydrocarbon based materials also have long been in use. U.S. Pat. Nos. 500,765, 889,049 and 960,064 each suggest the use of alcohol as a fuel to burn and produce heat. In the '765 and '049 reference alcohol is burned in a cooking stove while the '064 reference sets forth an alcohol burning pocket heater.

SUMMARY OF THE INVENTION

A burner unit of this invention has a fuel cell carried on a grate which in turn is connected to a base plate. The fuel cell includes a container portion having sidewalls with guides which extend inward beyond a rear wall of the container portion. A lid having slides operatively engaging the container guides may be positioned to open or close the container portion where fuel containing canisters are held. Artificial logs may be placed on the grate and fuel cell lid.

The base plate is formed with a cutout to hold a piece of tinted glass, for example. The glass allows light from a fixture attached to the base plate to shine upward and reflect from rock pieces on the glass. The burner unit may be formed as part of an enclosure. The enclosure in turn may be placed in a wall opening, piece of furniture or the enclosure may be freestanding.

To use the burner unit the fuel cell lid is positioned to allow ignition of fuel in the canisters. The fuel burns with a slight flame to form heat and smokeless, nontoxic products of combustion which need not be vented from the space in which the unit is located. Vents in the fuel cell allow air to circulate about the canisters to regulate surface tempeatures of the canisters and fuel cell and prevent the fuel from overheating. Light reflecting from the rock pieces produces a glowing ember effect from under the grate.

The burner unit of this invention provides several advantages over other such units presently known or in use.

First, the burner unit produces the sensorial effects of a traditional fireplace. Those about the unit are warmed by the generated heat while at the time enjoy the appearance of an open flame and glowing coals therebeneath. The fuel can be scented to produce a wood burning odor if desired. Thus, one may enjoy the physiological effects of open burning in a fireplace without having one.

Secondly, the unit may be used by those living in a multi-family dwelling unit, such as an apartment, where it is most uncommon to find a traditional fireplace. Additionally, the unit is quite portable and thus may be moved to and used in other subsequent locations of a similar nature.

Lastly, the unit is safe to operate without a need for undue precautions. The fuel canisters may be readily removed and replaced since air circulating about the fuel cell prevents the canisters or fuel cell from becoming overly hot.

Additionally, the burning fuel may be extinguished by simply sliding the fuel cell lid forward to cover the container portion and deprive the fuel of sufficient oxygen to continue to burn. Any residual fumes in the cell are vented through lid openings. If the unit were to be tipped forward inadvertently, the lid self-closes. Of most importance to a consumer is that the unit as combined with the noted enclosure is Code approved.

DESCRIPTION OF THE PREFERRED EMBODIMENT

Figure 2:
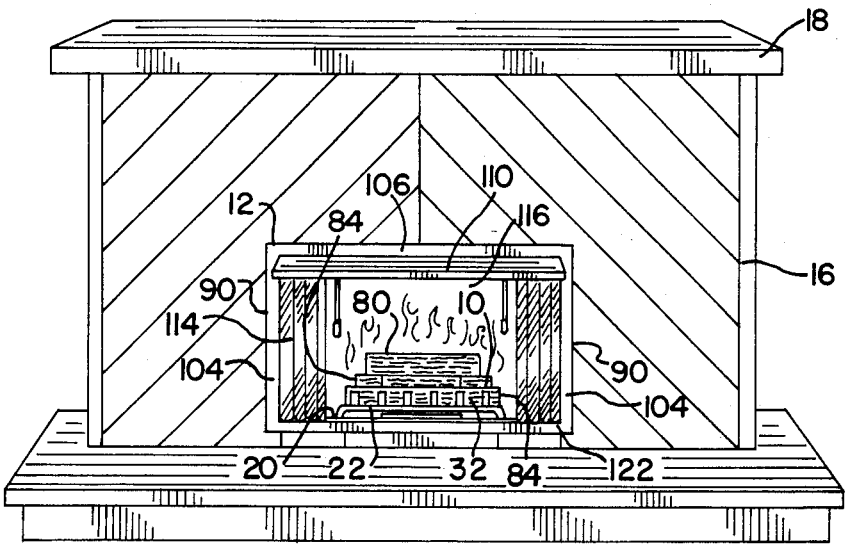
FIG. 2 is a perspective view of the burner unit and enclosure forming part of a decorative furniture piece.
Figure 1:
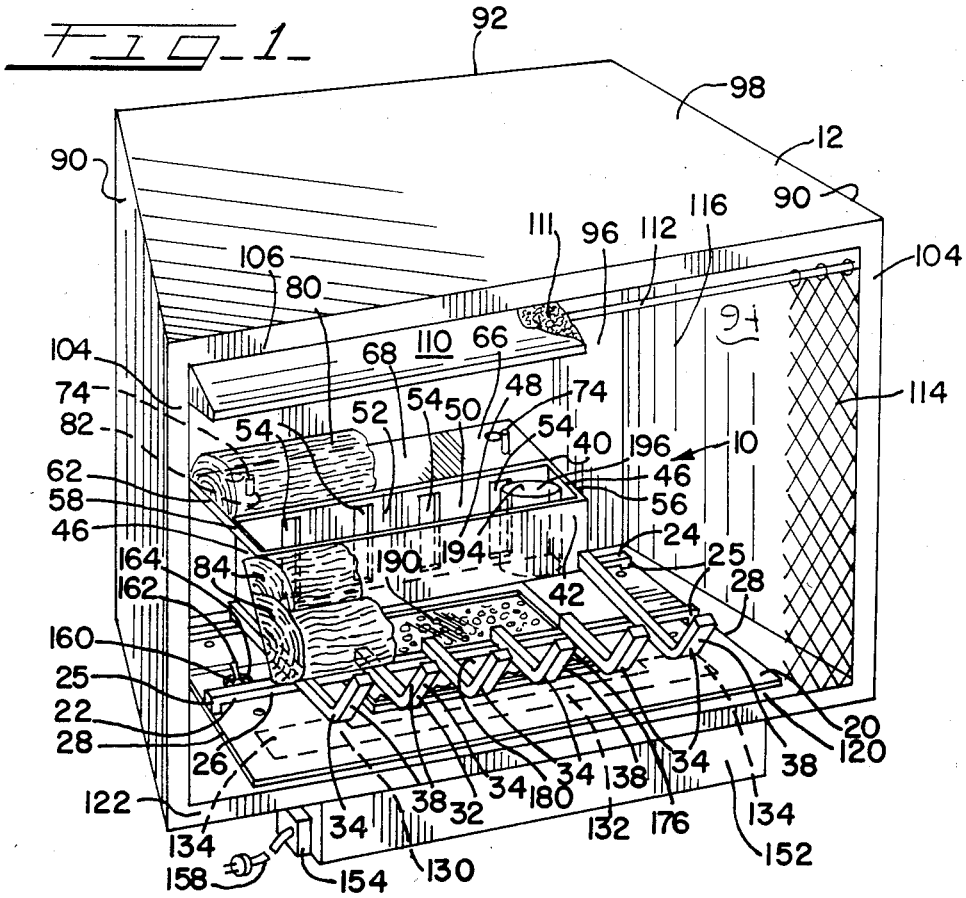
FIG. 1 is a perspective view of a burner unit of this invention installed in a freestanding enclosure.

A burner unit of this invention is shown generally in FIGS. 1 and 2 and designated 10. As shown, the unit 10 is positioned in an enclosure 12. The unit 10 and enclosure 12 may be formed as one assembly, and as shown is freestanding. In FIG. 2 the unit and enclosure 10 and 12 are installed in a furniture piece, for example a chest 16 having a hinged lid 18 providing access to an interior storage space. Alternatively, the unit and enclosure 10 and 12 may be installed in a wall opening in a dwelling space. It should be understood that the unit 10 also may simply be placed on a standard hearth of a traditional fireplace. In this latter case no enclosure 12 would be required.

The burner unit 10 includes a base plate 20 to which is attached a front and rear support frame 22, 24. Each frame 22, 24 has a pair of legs 25 which connects with a cross member 26. The legs 25 are positioned next to side edges 28 of the plate 20 with the rear support frame 24 aligned with a rear edge 30 of the plate 20. The support frames 22, 24 carry a grate 32 defined by a set of equispaced bars 34. Each grate bar 34 has a horizontal extension 36 which connects with a front upright segment 38 that act as stops. The segments 38 are positioned at a slight angle from the vertical.

A fuel cell 40 is affixed to the grate horizontal extensions 36 and includes a lower container portion 42. The container portion 42 is formed by a bottom wall 44, spaced apart sidewalls 46 and a front and a rear wall 48, 50 which join to define an interior space 52. In the container portion rear wall 50 is a set of vertical slots 54, see FIG. 1. Attached to the sidewalls 46 along an upper edge 56 of each is an angle shaped guide 58. These guides 58 extend rearward beyond the rear wall 50. An inner end 60 of each guide 58 aligns with the base plate rear edge 30.

Figure 7:
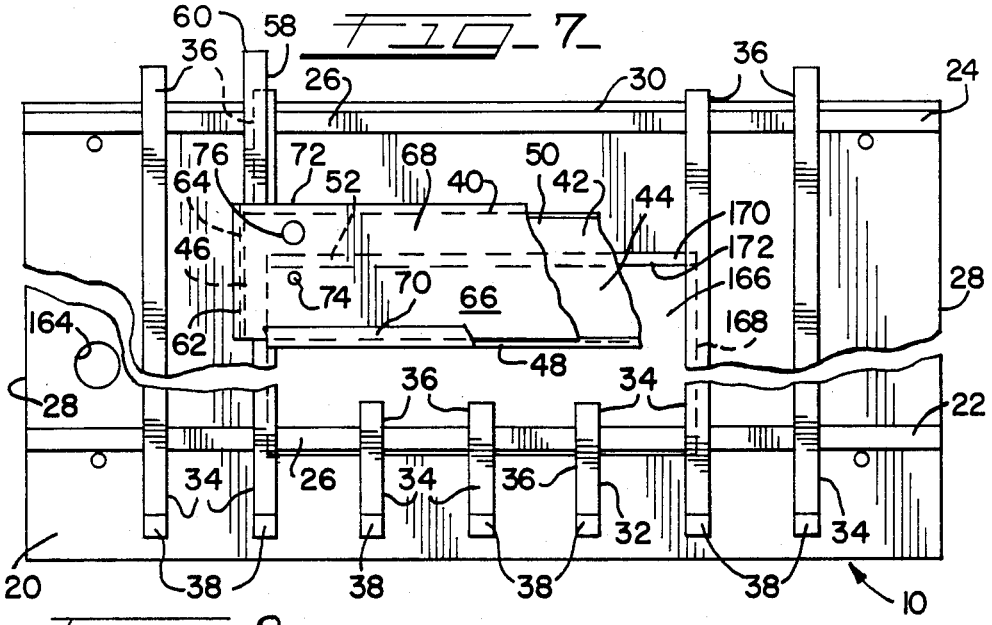
FIG. 7 is detailed plan view partially in section of the burner unit.
Figure 8:
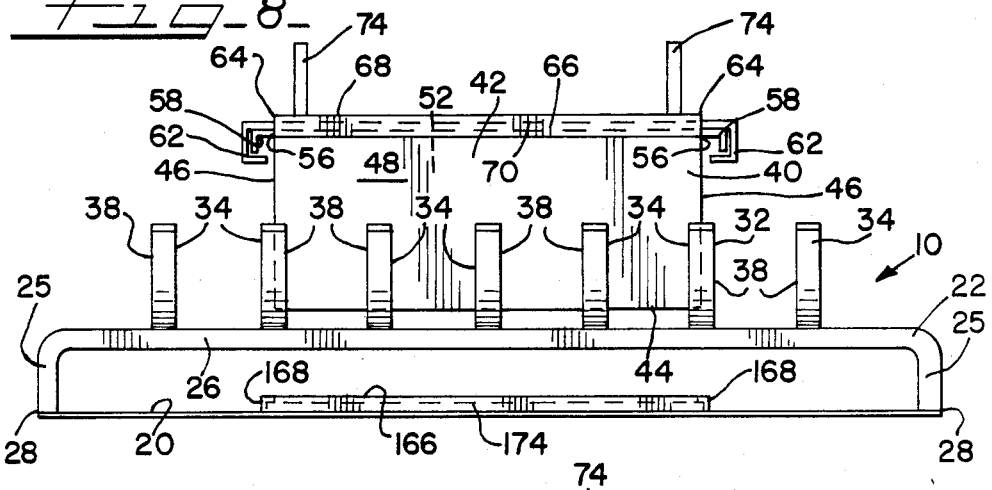
FIG. 8 is a front elevation view of the burner unit.
Figure 9:
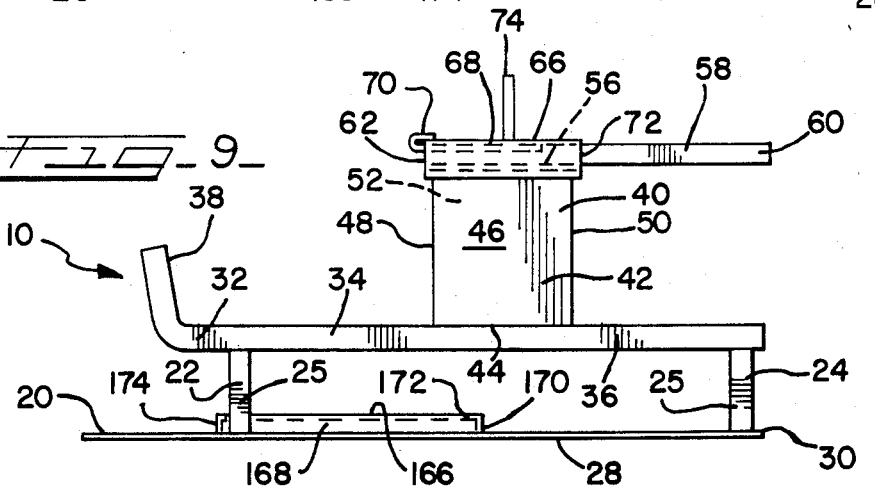
FIG. 9 is a side elevation view of the burner unit.

Assembled to the container portion guides 58 is a pair of channel shaped slides 62 attached to sides 64 of a lid 66. The lid 66 further includes a top wall 68 formed with a folded, upturned front edge 70. Attached to the lid top wall 68 is a back wall 72. Forward movement of the lid 66 is limited by engagement of the lid back wall 72 with the container portion rear wall 50. Attached to the lid top wall 68 is a pair of upward extending spaced apart mounting posts 74 which are located in front of vent openings 76 in the top wall 68, see FIG. 7.

As seen in FIG. 1, the burner unit 10 further includes a set of log pieces. An upper log piece 80 is formed with inner openings 82 to receive the lid posts 74 and secure the upper log 80 to the fuel cell lid 66. Two lower log pieces 84 are positioned on the grate extensions 36 between the fuel cell front wall 48 and the grate bar upright segments 38. The log pieces 80, 84 may be made of a non-combustible material, for example a ceramic.

Figure 3:
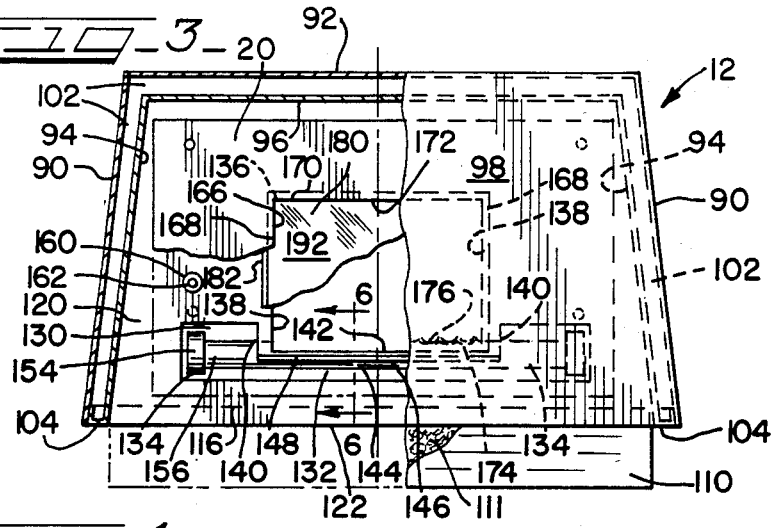
FIG. 3 is a plan view partially in section of the enclosure with all but a portion of a base plate of the burner unit removed.

The burner unit 10 may be made as an integral part of the enclosure 12. As so combined, the fuel cell guides 58 may be attached to an enclosure inner back wall 96. As shown in detail in FIGS. 3–5, the enclosure 12 is made having a double wall construction comprising outer sidewalls 90 which taper rearward to join an outer back wall 92. Inner sidewalls 94 are spaced from the outer sidewalls 90 and connect with the inner back wall 96 which is spaced in a like manner from the outer back wall 92. Likewise, an outer and inner top wall 98, 100 are spaced apart and connect with the sidewalls 90, 94 and back walls 92, 96. Spaces 102 formed between the various inner and outer walls may be filled with dead air or filled with an insulating material to insure that the outer walls 90, 98 remain at a safe temperature during unit use.

The sidewalls 90, 94 and the top walls 98, 100 each have a front flange which connect respectively to form side mullions 104 and a top mullion 106. Attached between the inner sidewalls 94 and to the inner top wall 100 next to the top mullion 106 is a deflector hood 110. The hood 110 is lined with an insulation piece 111. Immediately below the hood 110 is a rod 112 which extends between the inner sidewalls 94 and attached to such. The rod 112 provides support for a foldable screen 114 which may be used to selectively cover a face opening 116 of the enclosure 12.

Figure 4:
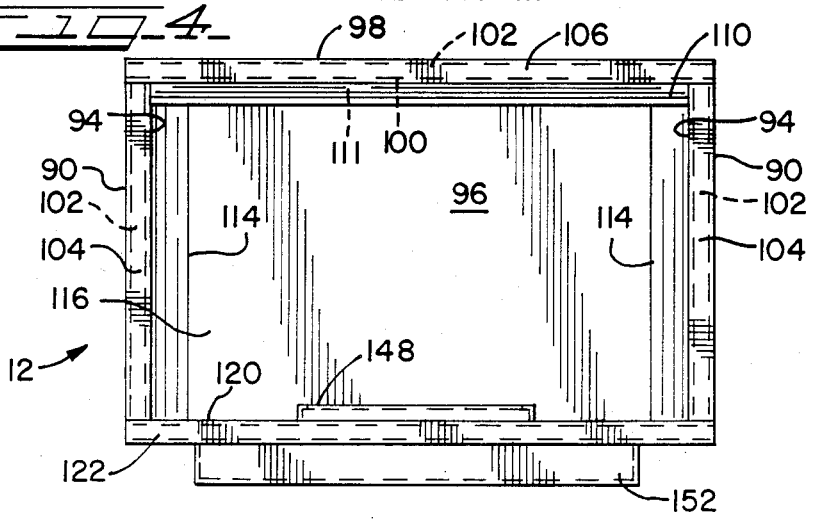
FIG. 4 is a front elevation view of the enclosure of FIG. 3.

The enclosure 12 further includes a bottom plate 120 with a front flange 122 similar in appearance to the top mullion 106 so that the face opening 116 is framed by the side mullions 104, top mullion 106 and bottom plate flange 122, see FIG. 4. The bottom plates 120 has a front cutout 130 defined by a narrow center portion 132 joined by enlarged end portions 134. Positioned immediately to the rear of the front cutout center portion 132 is a rear cutout 136. The rear cutout 136 has side edges 138 located adjacent inner sides 140 of the front cutout enlarged end portions 134. A front edge 142 of the rear cutout 136 in turn is located adjacent to a rear side 144 of the front cutout center portion 132. A connecting strip 146 having an upright flange 148 separates the front cutout center portion 132 from the front edge 142 of the rear cutout 136.

Figure 5:
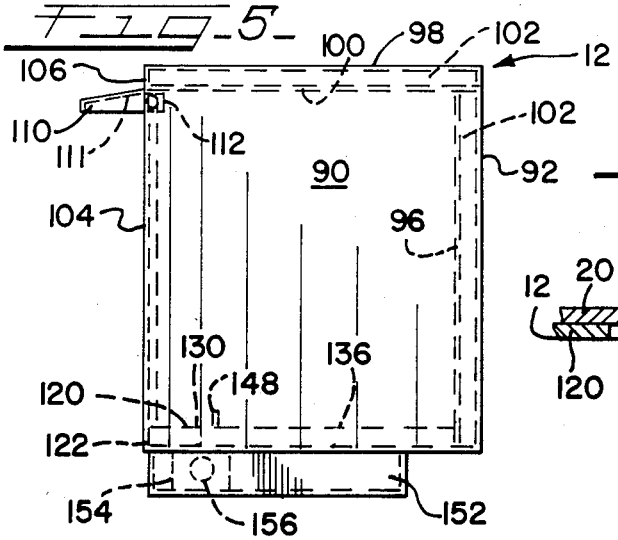
FIG. 5 is a side elevation view of the enclosure.

As seen in FIGS. 1, 4 and 5, the enclosure 12 is positioned on a base 152. The base 152 has sufficient height for installation of a fluorescent light fixture 154 of standard construction and circuitry for a fluorescent lamp 156. The fixture 154 may connect directly with a 110 volt source of electricity by a cord 158. Alternately, the fixture 154 may include a junction box (not shown) for direct wiring to a circuit, for example in a wall opening. Note that the fixture 154 is positioned to align with the enclosure bottom plate front cutout 130. The fixture 154 is operated by a switch 160 mounted in the enclosure bottom plate 120.

Figure 6:
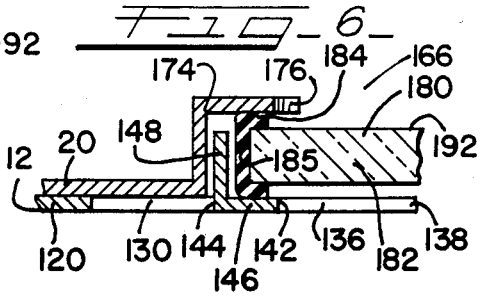
FIG. 6 is a section view as seen generally along the line 6—6 of FIG. 3.

A toggle lever 162 of the switch 160 projects upward through an opening 164 in the burner unit base plate 20 with the burner unit 10 positioned on the enclosure bottom plate 120. As best understood by viewing FIGS. 3 and 6, the burner unit base plate 20 also is formed with a cutout 166 substantially the same size as the enclosure rear cutout 136 and positioned to align with such with the unit 10 in the enclosure 12. About the burner unit base plate cutout 166 are raised, angle shaped lip portions. Side lip portions 168 and a rear lip portion 170 have a straight top edge 172 while a front lip portion 174 is formed with a series of scallops 176.

Positioned between the enclosure bottom plate 120 and the raised lip portions 168, 170 and 174 of the burner unit base plate cutout 166 is a transparent member 180. This member 180 may be a piece of glass or plastic, for example. Edges 182 of the member 180 are encased in a channel shaped gasket 184 so as to suspend the member 180 between the bottom plate 120 and burner unit base plate cutout raised lip portions 168, 170 and 174. Note that the gasket 184 on a front edge 185 of member 180 abuts the connecting segment flange 148, see FIG. 6. This flange 148 aids locating the transparent member 180 while the burner unit base plate 20 to being positioned to align the cutouts 136, 166. Note further than when the burner unit 10 is not used in the enclosure 12, the base 152 has a top wall similar to the enclosure bottom plate 120 to hold the transparent member 180 as described above.

To prepare the burner unit 10 for use, the fluorescent lamp 156 is installed in the base light fixture 154; then the light fixture 154 connected to a power source. When the unit 10 is to be placed on the bottom plate 120 for use in the enclosure 12, the front cutout 130 provides access to the fixture 154. The enlarged end portions 134 allow for manual rotation of the lamp 156 to secure the lamp 156 in the fixture sockets. In the explanation of burner operation, it is assumed that the burner unit 10 is installed in the enclosure 12.

Next, several rock pieces 190 are placed on a top surface 192 of the member 180. The preferred rock material is lava. The switch lever 162 is placed at "ON" to illuminate the rock pieces 190 producing a visual effect of burning coals. Since a reddish glow is needed, the member 180 is tinted or the lamp 156 color coated accordingly. The scallops 176 on the cutout front lip portion 174 aid in creating an authentic glowing ember appearance because the scallops 176 make an irregular demarcation line between the lighted member 180 and the non-lighted burner unit base plate 20.

Canisters 194 containing a fuel 196 then may be placed in the fuel cell container potion 42 by sliding the lid 66 and attached upper log piece 80 to the rear. The canisters 194 may be a standard one-pint size so that the container portion 42 holds three such canisters 194. The preferred fuel is a gelled alcohol identified in copending patent application Ser. No. 619,041 filed June 11, 1984. This fuel burns with a slight flame and without forming toxic products of combustion or smoke. Additionally, the fuel 196 may be scented to burn with a wood odor, for example.

The fuel 196 may be ignited with a safety match or pocket lighter. Burning of the fuel 196 is regulated in part by the slots 54 in the fuel cell container portion rear wall 50 which allows air to flow to the flame and about the canisters 194. This air flow helps to cool the canisters 194 and fuel 196 to maintain burning at a rate sufficiently low to prevent overheating of the fuel cell 40 and enclosure 12, for example. Heat from the burning fuel 196 passes through the screen 114, which should have been pulled closed for safety reasons, and is directed by the hood 110 into the space in which the unit and enclosure 10, 12 are located.

When use of the burner unit 10 is no longer desired, the screen 114 may be pulled to one side of the enclosure face opening 126 to provide access to the fuel cell 40. The lid 66 and attached upper log piece 80 then may be slid forward to enclose the canisters 194. Because the air flow to the fuel 196 is no longer sufficient to sustain combustion, and the flame is extinguished. Note that if the unit and enclosure 10, 12 were inadvertently tipped forward as the fuel 196 is burning, the lid and log 66, 80 would slide forward under the influence of gravity to enclose the canisters 194 and likewise extinguish the flame. Any vapor from the now extinguished fuel 196 produced by residual heat in the canisters 194 and fuel cell 40 vents through the lid openings 76 to prevent a build-up of vapor in the now closed fuel cell 40. Last, the light fixture 154 is deenergized by moving the switch lever 162 to the "OFF" position.

While an embodiment of this invention has been shown and described, it should be understood that this invention is not limited hereto except by the scope of the claims. Various modifications and changes can be made without departing from the scope and spirit of the invention as the same will be understood by those skilled in the art.

What I claim is:

1. A burner unit particularly adapted for use in a nonvented enclosure, said unit comprising:

a base with enclosed light source, a base plate connecting with and positioned over said base with said plate formed with a cutout having an irregular front edge, glass means positioned in said cutout to provide upward illumination from said light source and to produce in part a visual glowing ember effect, grate means attached to said base plate above said cutout, a fuel cell having a container portion connecting with said grate means and a lid portion having slides operatively connecting with guides attached to sides of said container portion to allow or preclude access to said fuel cell container portion, and vent means formed in said fuel cell container portion and said lid to allow air circulation about fuel canisters disposable in said fuel cell container portion, wherein during use of said burner unit fuel in said canisters may burn to produce heat with a temperature of said fuel, said fuel canisters and said fuel cell regulated by said air circulation, and light from said light source passing through said glass means to reflect from rock pieces disposable on said glass means may visually simulate glowing embers under said grate means, and during non-use of said burner unit said fuel cell lid may be positioned to enclose said container portion and limit said circulation of air sufficiently to inhibit combustion therein while allowing air circulation sufficient to vent said fuel cell as required.

2. A ventless fireplace assembly for use in a furniture piece or a dwelling wall opening, said assembly comprising:

a double wall enclosure carried on a base, an electrical fixture positioned in said base to create an upward illumination through a cutout formed in a bottom plate in said enclosure, and a burner unit having a base plate carried on said enclosure bottom plate with said base plate having a cutout aligning with said enclosure bottom plate cutout, a raised lip formed about said base plate cutout to hold a tinted transparent member to add color to said illumination, and a fuel cell carried on a series of grate bars attached to frames on said burner unit base plate, said fuel cell having a lid slidable to a first position to provide a clear opening to a container portion of said fuel cell or to a second position to enclose an inner space of said container portion, with said fuel cell including vents to allow circulation of air into and out of said fuel cell with said lid in said first or said second position, wherein a non-toxic burning fuel may be ignited and burned in said fuel cell to emit heat from a face opening of said enclosure with external surfaces of said enclosure remaining at a safe temperature to touch.

3. A burner unit comprising:

a base plate, an inner and outer support frame each having a pair of spaced apart legs attached to said base plate and a cross member connecting with said legs, a set of grate bars equispaced on said frames with said bars having upright segments forming a front holding means and horizontal extensions connecting with said segments, a fuel cell assembly having a container portion attached to said grate bar extensions, an angle shaped guide attached one each to sidewalls of said container portion and extending to a rear of a rear wall of said container portion and a lid having channel shaped slides in operative engagement with said guides to allow said lid to cover said container portion or provide clear access to an inner space of said container portion, and vents formed in said container portion rear wall and a top wall of said lid, a transparent member having edges carried in a raised lip portions formed about a cutout in said burner base plate, and a light fixture connecting with said base plate beneath said cutout to illuminate said transparent member to a glowing ember-like color.

4. A burner unit as defined by claim 3 and further characterized by, an artificial log piece positioned on posts attached to said fuel cell lid, and rock pieces of a lava-like material placed on a top surface of said transparent member with a selective number of said pieces located adjacent to scallops formed on a front top edge of said raised lip portions, wherein said light passing through said transparent member reflects from said rock pieces thereon to glow as burning coals.

5. A burner unit as defined by claim 3 and further characterized by, fuel canisters carried in said fuel cell container portion to hold fuel means combustible to form smokeless, non-toxic products, wherein said fuel means may be burned in a non-vented dwelling space.

6. A burner unit as defined by claim 3 and further characterized by, an enclosure formed about said burner unit and connecting therewith, said enclosure having inner and outer walls spaced apart to define therebetween an insulating space with said walls forming a face opening for a hood projecting outward from said face and a screen to provide selective closure of said opening.

7. A burner unit as defined by claim 3 and further characterized by, an enclosure having double sidewalls and a double top wall and a bottom plate connecting with said sidewalls to support said burner unit base plate, a front cutout formed in said enclosure bottom plate to provide access to said light fixture for installation of a lamp therein, a rear cutout formed in said enclosure bottom plate and separated from said front cutout a connecting segment with an upright flange for positioning a front edge of said transparent member with said enclosure bottom plate rear cutout being substantially aligned with said burner unit base plate cutout, and an insulating channel encasing edges of said transparent member to space surfaces of said member from said burner unit base plate and from said enclosure bottom plate respectively.

* * * * *